United States Patent [19]

Sandeen

[11] 4,223,687

[45] Sep. 23, 1980

[54] COMBINATION SMOKING DEVICE AND A LIGHTER FOR SMOKING MATERIAL

[76] Inventor: Michael W. Sandeen, 2120 Longview Dr., San Leandro, Calif. 94577

[21] Appl. No.: 952,778

[22] Filed: Oct. 16, 1978

[51] Int. Cl.[3] ..... A24F 3/00

[52] U.S. Cl. ..... 131/180; 131/185; 431/253; 206/86

[58] Field of Search ..... 431/253; 131/185, 7; 206/86

[56] References Cited

U.S. PATENT DOCUMENTS

| | | | |
|---|---|---|---|
| 1,053,039 | 2/1913 | Karnes | 131/185 X |
| 2,549,726 | 4/1951 | Van Tull | 131/185 |

*Primary Examiner*—Carroll B. Dority, Jr.
*Assistant Examiner*—Randall L. Green
*Attorney, Agent, or Firm*—Alvin E. Hendricson; William R. Piper

[57] ABSTRACT

A combination smoking device and a lighter for the smoking material in which the combustion area for the smoking material has a mouth piece swingable from an inoperative position into an operative position and in which an auxiliary supply of smoking material includes a valve that may be opened for placing the auxiliary supply in direct communication with the combustion area for replenishing it with a fresh supply of smoking material. Also, a smoking material lighter is positioned adjacent to the combustion area so that the operator can fill the area with smoking material and then ignite a wick and swing the mouth piece into operative position and suck air therethrough for creating a down draft in the combustion area for causing the flame from the ignited wick to ignite the smoking material. A hinged cover may now be closed for extinguishing the wick flame, the cover having air passages for supplying sufficient air to the combustion area for maintaining a continuous burning of the smoking material.

3 Claims, 4 Drawing Figures

COMBINATION SMOKING DEVICE AND A LIGHTER FOR SMOKING MATERIAL

SUMMARY OF THE INVENTION

An object of my invention is to provide a compact smoking device and a lighter for the smoking material in the combustion chamber in which a hinged cover when closed will enclose the lighter for the smoking material as well as close the open top of the combustion chamber. A swingable mouth piece may be swung from an inoperative position where it will form a part of the compact smoking device into an operative position where it will extend from the device to function as a mouth piece and it includes a smoke conveying passage that will be in direct communication with the combustion chamber. A hinged cover functions as a closure for the smoking material lighter device as well as a closure for the combustion chamber when the cover is closed. Yet, the cover has air passages for feeding air to the commbustion chamber thus permitting the device to be used for smoking by the operator when the mouth piece is swung into operative position.

A further object of my invention is to provide a compact smoking device in which the lighter for the smoking material is placed adjacent to the combustion chamber and when the cover is in open position annd the wick has been ignited by a spark from the flint, a drawing of air through the mouth piece, which is in operative position, will create a down draft of air into the top of the combustion chamber and will direct the flame from the burning wick into the smoking material for igniting it. A subsequent closing of the cover will enclose and extinguish the wick flame but the air passages in the cover will supply air to the combustion chamber for permitting the device to be used for smoking.

DESCRIPTION OF THE PREFERRED EMBODIMENT

In carrying out my invention I provide a main body indicated generally at A, in FIGS. 1 to 4, inclusive, and it is preferably made of metal, but can be made of any material desired. The exterior shape of the body is in the form of a prism and it has a cover B, hinged to the body at 1, and it has a swingable mouth piece C, shown in closed position in FIG. 1 and in operative position in FIG. 2. When the cover B, is closed and the mouth piece C is in inoperative position, they will cooperate with the main body A to form a compact device in the form of a prism and it can be readily carried in the pocket of a garment or in a purse if the device is to be used by a woman.

Figure 1:
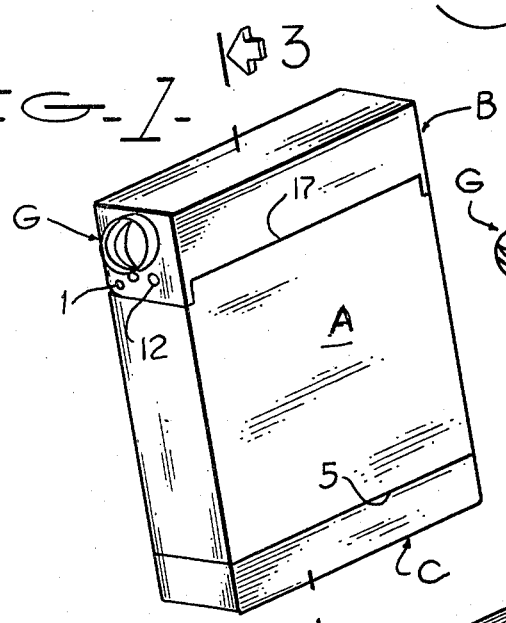
FIG. 1 is an isometric view of the device showing the cover in closed position and the swingable mouth piece in inoperative position.
Figure 2:
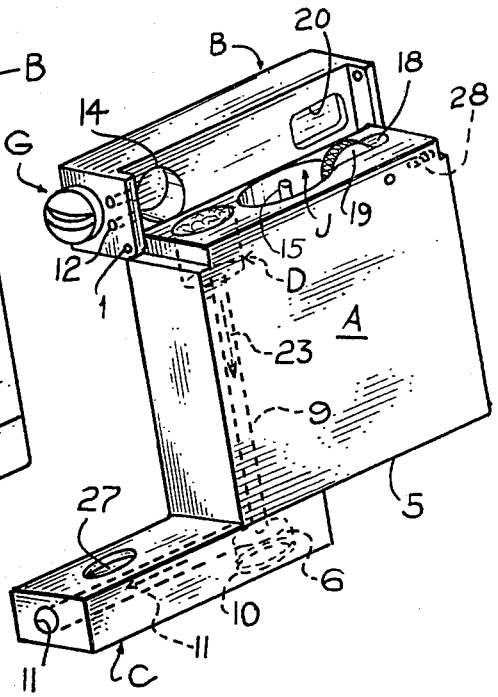
FIG. 2 is a view similar to FIG. 1, but shows the cover in open position and the mouth piece swung into operative position.
Figure 3:
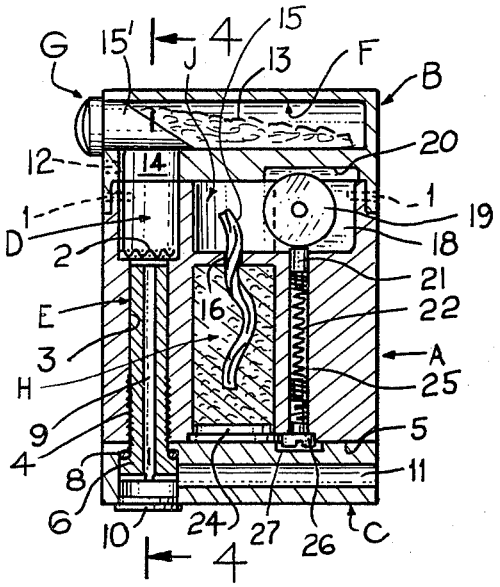
FIG. 3 is a longitudinal vertical section through the device and taken along the line 3—3 of FIG. 1.
Figure 4:
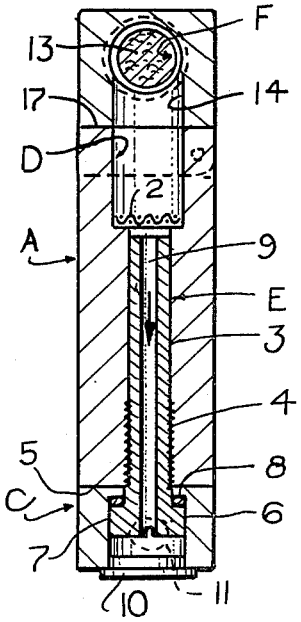
FIG. 4 is a transverse section through the device and is taken along the line 4—4 of FIG. 3.

I will first describe the structure dealing with the smoking portion of the device and then will describe the structure pertaining to the igniting of the smoking material received in the combustion chamber located in the main body A. In FIGS. 3 and 4, I show a combustion chamber D, in the body A, and this chamber is shown in the isometric view of FIG. 2. A screen 2 is placed at the bottom of the smoking chamber D. A metal tube E is placed in a bore 3 in the body A and the axis of the tube is aligned with the axis of the cylindrical combustion chamber D. The tube E has a threaded portion 4 that is received in a threaded portion of the bore 3.

Both FIGS. 3 and 4 show the tube E, extending below the bottom 5 of the main body A, and this portion 6 is of a greater diameter than the rest of the tube. The mouth piece C has a cylindrical recess 7 for receiving the enlarged end portion 6 of the tube and forms a swivel joint interconnecting the mouth piece to the main body A. An "O" ring 8 functions as a seal between the swingable mouth piece C, and the main body A. When the mouth piece is in inoperative position, see FIGS. 1, 3 and 4, it will constitute a continuation of the main body A, and will appear as an integral part thereof.

The interior of the tube E forms a passageway 9 for smoke generated in the combustion chamber D, and the enlarged end 6 of the tube has a length that is less than the length of the cylindrical recess 6 in the mouth piece. This will leave a space in the recess 6 and a friction cap 10 closes the open end of the recess 7. The mouth piece C has a longitudinal smoke conveying passage 11 therein whose axis extends at right angles to the axis of the tube E. The passage 11 communicates with the recess 7 and it will be seen from this that the passage is always in communication with the passage 9 in the tube E regardless of whether the mouth piece is in operative or inoperative position.

I will first describe how air passages 12 in the cover permit air to enter the combustion chamber D even when the cover is closed and I will also set forth how the cover has an auxiliary reservoir F for containing an additional supply of smoking material 13 that may be fed directly into the combustion chamber D when needed. The reservoir F extends substantially throughout the length of the cover as shown in FIG. 3 and a dispenser valve G normally closes the open end of the reservoir as well as normally closes the passage 14 that directly connects the reservoir F with the open top of the combustion chamber D. It will be noted from FIG. 3 that the inner end of the valve G, is inclined as at 15' so that when the valve is in the position shown in FIG. 3, the passage 14 in the cover B, is closed. The valve G can be rotated on its axis through 180° and this will swing the inclined inner end 15' of the valve so as to uncover the passage 14. The closed cover can now be tilted when the main body A is tilted for feeding smoking material 13 from the reservoir F, into the combustion chamber D and this will be done by gravity. The smoking material 13 will fill the combustion chamber and the passage 14 in the cover will permit a mound of the smoking material to form above the top of the smoking chamber. When the cover is opened, the operator may press downwardly on the exposed mound and thus compact the smoking material in the chamber. The valve G, is rotated into closed position before the cover is opened. The air passages 12 in the cover B, are in communication with the cylindrical passage 14 at all times and in this way air is fed into the combustion chamber D even though the cover is closed.

I will now set forth the means for igniting the smoking material in the combustion chamber D. In FIG. 3, I show the body A with a cylindrical cavity H whose axis parallels the axis of the tube E. The cavity H extends upwardly from the bottom 5 of the main body A, and it is filled with cotton saturated with a burnable fuel. A wick 15 is embedded in the cotton and has its exposed end extending through an opening 16 and received in another cavity J that extends to the top 17 of the main body A.

The cavity J has a recess 18 in which a striker wheel 19 is rotatably mounted. A portion of the striker wheel extends above the top 17 of the main body as is shown in FIGS. 2 and 3, and the cover B has a recess 20 in its undersurface that will receive the exposed portion of the striker wheel when the cover is closed. The periphery of the striker wheel is knurled and a flint 21 is yieldingly held against the knurled periphery of the striker wheel by a coil spring 22 so that when the wheel is manually rotated clockwise when looking at FIG. 3, a spark will be generated and will strike the fuel saturated wick 15 to ignite. The flame from the burning wick will be drawn over to the smoking material in the combustion chamber D when the operator swings the mouthpiece into the operative position shown in FIG. 2 and sucks air through the smoke passage 11 and forces air downwardly in the passage 19 in the main body as indicated by the arrow 23. The downdraft of air into the combustion chamber D will force the wick flame against the smoking material to ignite it. When this is accomplished, the cover B may be closed and will close the top of the cavity J, and this will extinguish the flame. Air will be continually delivered to the combustion chamber D through the air passages 12 and 14 and thus permit the device to be used for smoking even though the cover is closed.

The cavity H in the main body A, is closed by a friction cap 24, see FIG. 3. The bore 25 in the body A receives the flint 21 and the coil spring 22. A screw cap 26 closes the lower threaded end of the bore 25 and compresses the spring 22 for yieldingly holding the flint against the periphery of the striker wheel 19. The head of the screw cap 26 extends a slight distance below the bottom 5 of the main body A so that the operator can gain access to it when the mouth piece C is in open position. FIG. 3 shows the mouth piece with a notch 27 therein for receiving the exposed portion of the cap screw 26 when the mouth piece is in closed position. When using the burning wick 15 for igniting the smoking material 13 in the combustion chamber D, it is possible to open the cover B, as shown in FIG. 2 and to also swing the mouth piece C, into operative position and then tilt the entire device clockwise through an angle of about 30° from that shown in this Figure so that the wick flame will be brought closer to the top of the chamber D. Then when the operator sucks in air through the mouthpiece, the downdraft created at the top of the chamber D, will bend the wick flame so as to contact the smoking material and ignite it to start it burning. The head of the screw cap 26 when received in the notch 27 in the upper surface of the mouth piece C after the mouth piece has been swung into inoperative position, functions as a locking device to prevent the accidental swinging of the mouth piece into open position. A spring biased ball 28 in the body A is yieldingly received in a recess in the cover B when the cover is closed so as to prevent the accidental opening of the cover.

I claim:

1. A combined smoking device and lighter for the smoking material comprising:

(a) a main body having a combustion chamber for holding the smoking material and opening out at the top of said body, said body also having a burnable fluid saturated wick disposed adjacent to the top of said chamber;

(b) a mouth piece swingably mounted on said body and movable from closed to open position and having a passage in communication with said chamber;

(c) means for igniting the wick whereby a drawing of air through said mouthpiece passage will create a downdraft at the top of the combustion chamber for causing the wick flame to bend and contact the smoking material to ignite it;

(d) a cover for the top of said body, said cover when in open position exposing the wick flame so that it will contact and ignite the smoking material when suction is applied at the mouthpiece passage, said cover being swingable into closed position on the body to enclose the top of the combustion chamber and to cover the wick, said cover having air passages therein which are brought into communication with the combustion chamber when the cover is closed; and (e) whereby the operator can continue to burn the smoking material in the combustion chamber by intermittently drawing in air and smoke through the mouthpiece passage.

2. The combination as set forth in claim 1: and in which (a) said cover has a reservoir for an additional supply of smoking material;

(b) a valve controlling a passage in said cover from said reservoir to said combustion chamber; and (c) whereby when the cover is closed and said valve is opened an additional supply of smoking material may be fed from said reservoir to said combustion chamber afterwhich said valve is closed before said cover is opened.

3. The combination as set forth in claim 1: and in which (a) the means for igniting said wick includes a first cavity in the top of said body which receives the exposed end of the wick;

(b) said body having a second cavity filled with a burnable fluid and in which said wick is immersed;

(c) said first cavity having a recess opening at the top of said body and having a striker wheel mounted in said recess; and (d) a spring biased flint mounted in said body and being yieldingly held against the striker wheel periphery, whereby a rotation of said striker wheel will cause the flint to generate a spark which will ignite the wick so that the burning wick will ignite the smoking material when suction is applied to the mouthpiece passage, said cover when closed enclosing the wick and striker wheel so that the wick will cease from burning through lack of oxygen being supplied thereto.

* * * * *